US009546634B2

(12) United States Patent
Jensen et al.

(10) Patent No.: US 9,546,634 B2
(45) Date of Patent: Jan. 17, 2017

(54) FUEL DISTRIBUTION RAIL

(71) Applicant: TI Automotive (Heidelberg) GmbH, Heidelberg (DE)

(72) Inventors: Hans Jensen, Dettingen unter Teck (DE); Uwe Fiedler, Altlußheim (DE); Andreas Heck, Sinsheim (DE)

(73) Assignee: TI Automotive (Heidelberg) GmbH, Heidelberg (DE)

( * ) Notice: Subject to any disclaimer, the term of this patent is extended or adjusted under 35 U.S.C. 154(b) by 108 days.

(21) Appl. No.: 14/458,384

(22) Filed: Aug. 13, 2014

(65) Prior Publication Data

US 2015/0047613 A1 Feb. 19, 2015

(30) Foreign Application Priority Data

Aug. 15, 2013 (DE) ..... 20 2013 103 710 U

(51) Int. Cl.

| | |
|---|---|
| ***F02M 69/46*** | (2006.01) |
| ***F02M 63/02*** | (2006.01) |
| ***F02M 55/02*** | (2006.01) |
| ***F02M 55/04*** | (2006.01) |
| ***F02M 61/16*** | (2006.01) |

(52) U.S. Cl.

CPC ..... *F02M 63/0275* (2013.01); *F02M 55/025* (2013.01); *F02M 55/04* (2013.01); *F02M 61/166* (2013.01); *F02M 69/465* (2013.01); *F02M 63/0225* (2013.01); *F02M 2200/03* (2013.01); *F02M 2200/315* (2013.01); *F02M 2200/8084* (2013.01)

(58) Field of Classification Search

CPC F02M 55/025; F02M 69/465; F02M 63/0225; F02M 55/04; F02M 2200/315

USPC ..... 123/456

See application file for complete search history.

(56) References Cited

FOREIGN PATENT DOCUMENTS

| | | | | |
|---|---|---|---|---|
| DE | 199 36 535 | A1 | 2/2001 | |
| DE | WO 03036075 | A1 * | 5/2003 | ..... F02M 55/025 |
| DE | 10 2008 013575 | B3 | 8/2009 | |
| GB | 2391908 | A * | 2/2004 | ..... F02M 51/005 |
| GB | 2 416 372 | A | 1/2006 | |
| WO | 03/036075 | A1 | 5/2003 | |

OTHER PUBLICATIONS

European Patent Office, International Search Report in European Patent Application No. 14 18 0405 (Dec. 8, 2014).

* cited by examiner

*Primary Examiner* — Lindsay Low
*Assistant Examiner* — Charles Brauch
(74) *Attorney, Agent, or Firm* — Brinks Gilson & Lione

(57) ABSTRACT

A fuel distribution rail for a fuel injection system of an internal combustion engine has connected base tube sections defining a longitudinal fuel channel with connector devices fixed on the base tube and a force relieving groove provided on the outer surface of the base tube sections spaced from the connector devices which extend over at least a part, preferably at least over a greater part of the outer surface of the base tube. In one form a cylindrical base tube has a circular force relieving groove surrounding the base tube spaced from the connector device.

20 Claims, 2 Drawing Sheets

FUEL DISTRIBUTION RAIL

CROSS-REFERENCE TO RELATED APPLICATIONS

This application claims priority pursuant to Title 35 USC §119 to German application for Patent Serial No. DE 20 2013 103 710.9 filed Aug. 15, 2013 entitled Fuel Distribution Rail. The entire content of the specification, claims and drawings of which are hereby incorporated herein reference, as if fully set forth herein.

BACKGROUND OF THE INVENTION

The invention concerns a fuel distribution rail for fuel injection for internal combustion engines, with a base tube and a fuel channel extending in the longitudinal direction with respect to the base tube whereby one connector device is at least fixed to the base tube. Such a fuel distribution rail is normally part of a fuel injection device of a multi-cylinder internal combustion engine of a vehicle. The fuel distribution rail may also be designated as a common rail.

Fuel distribution rails of the type mentioned at the outset are, in practice, known in different embodiments. These fuel distribution rails are generally under high internal pressure and in particular also variations in internal pressure. Further, such fuel distribution rails are also subject to vibrations and similar mechanical stresses occurring in the region of the engine. For these reasons, the fuel distribution rails must meet the high requirements in quality and service life. Particularly, they must fulfill high requirements of strength. Weak areas with respect to strength, particularly in joint areas like solder or weld areas and particularly in joint regions of the base tube sections as well as in connection areas of lateral connection pipelines. Due to mechanical stresses, frequent breaks and/or cracks occur in these areas. In this respect, there is room for improvement in fuel distribution rails known in practice.

Thus, the technical problem on which the present invention is based lies in providing a fuel distribution rail mentioned at the outset, in which the described disadvantages can be avoided and which distinguishes itself by resistance to mechanical stresses, particularly in the joint regions.

SUMMARY OF THE DISCLOSURE

For the solution of the technical problem, the invention teaches of a fuel distribution rail as mentioned at the outset, which is characterized by the fact that a force relieving groove is arranged in the outer surface of the base tube in the area of the connector device. The force relieving groove extends over at least a part, preferably at least over a greater part of the outer surface of the base tube. According to a particularly preferred embodiment of the invention, at least one force relieving groove is arranged or worked into the outer surface of the base tube in the region of each connector device.

A recommended embodiment of the invention is characterized by the fact that the base tube is of metal or essentially of metal and preferably of metal tubing, particularly of steel tubing. The base tube can also be of aluminum or essentially of aluminum.

It is within the framework of the invention that the fuel channel extends over a large portion of the length and preferably over the entire length or essentially of the entire length of the base tube. It is further within the framework of the invention and characterized by the fact that several connector devices are arranged over the length of the base tube which communicate with the fuel channel of the base tube.

The base tube can be a continuous, single-piece base tube. According to a preferred embodiment of the invention, the base tube consists of a plurality of base tube sections. It is within this framework that one connector device is a connector adapter for connecting at least two base tube sections of the base tube. In this preferred embodiment of the invention, a connector device or a connector adapter is a connecting element between two tube sections of the base tube. It is further within the framework of this invention that the tube sections of the base tube are locked or positively locked into the connector adapter. To realize a straight-line of linear base tube, two tube sections latch into recesses in the connector adapter on opposite sides. It is within the framework of this invention that the tube sections connected are fixed within the recesses of the connector adapter. This is explained in detail below.

The invention is based on the knowledge that the areas of the base tube with the connector devices are particularly mechanically stressed. For this reason, a force relieving groove or as per this invention, force relieving grooves are provided in the base tube sections in the region of the connector devices. Expediently, a force relieving groove has just a relatively small distance from the nearest assigned connector device. This distance is specified in detail below.

A particularly preferred embodiment of the invention is characterized by the fact that a connector adapter is of metal, particularly of steel or essentially metal, particularly essentially of steel. It is recommended that a connector adapter has a flange component that at least partly and preferably entirely encloses the base tube or the end of the tube section.

A recommended embodiment of the fuel distribution rail as per this invention is characterized by the fact that the connector adapter is connected to the assigned tube section by a soldered joint and/or a welded joint. It was mentioned at the outset that such connection areas or points, particularly soldered joints and/or welded joints are particularly mechanically stressed or are particularly mechanically unstable. For this reason, force relieving grooves are provided near these joint areas or points.

A preferred embodiment is characterized by the fact that the flange component of a connector adapter is connected to the assigned tube section of the fuel distribution rail over a soldered joint and/or a welded joint. Expediently, a tube that is to be connected fits into a recess of a connector adapter, which is formed by the flange component. The tube section is preferably connected to the assigned flange components in the recess as over soldered and/or welded joints.

An embodiment of the invention is characterized by the fact that in another form, at least one connector device comprises a connecting branch connected to the base tube or a tube section, whereby this connecting branch is, as recommended, has fluid connection with the fuel channel. This concerns particularly a connecting branch that extends transversely to the base tube or transversely to the tube sections. Expediently, such a connecting branch is connected through a bore in the base tube or tube section of the base tube. It is within the framework of this invention that, with regard to connecting branches, this embodiment particularly concerns feed lines to the fuel injectors or injector valves of a fuel injection device.

It is further within the framework of this invention that a force relieving groove encircles the entire outer circumference of the base tube or the tube section of the base tube. As recommended, a force relieving groove has a crescent shaped or circular crescent shaped cross section. A preferred embodiment of the invention is characterized by the fact that a force relieving groove provided has a maximum depth of 0.2 to 1.0 mm, preferably from 0.3 to 0.8 mm and particularly preferred from 0.3 to 0.7 mm. The maximum depth is measured from the groove minimum depth or from the deepest point of the force relieving groove relative to the outer surface of the tube.

It is determined that the maximum breadth of the force relieving groove is 1.5 to 3 mm, preferably 2 to 3 mm. The maximum breadth is measured at the level of the remaining outer surface of the base tube or the tube section, particularly with grooves with crescent shaped or circular crescent shaped cross sections.

In accordance with the preferred embodiment of the invention, the distance between the minimum depth of a force relieving groove and the longitudinal central axis of the nearest neighboring connector adapter is 8 to 20 mm, preferably 10 to 18 mm and particularly preferred 10 to 16 mm. The distance here is measured from the longitudinal central axis of the connector adapter, which lies next to the force relieving groove. It is also preferred that the distance between the groove minimum depth of the force relieving groove and tube end fitted into the next neighboring connector adapter of tube section is 7 to 15 mm, and preferably 9 to 13 mm. The outer diameter of the base tube or the tube section is preferably 15 to 27 mm, preferably 17 to 25 mm. Expediently, the wall thickness of the base tube or the tube section is 2 to 4 mm, preferably 2 to 3.5 mm.

The invention is based on the knowledge that the fuel distribution rail as per this invention outstandingly fulfills the strength requirements even at high inner pressures and variations of inner pressure. Especially at weak points and particularly at joints in soldered or welded areas on connector devices of the base tube, the fuel distribution rail as per this invention excels itself through a surprisingly high mechanical resistance. Breaks and cracks due to mechanical stresses, for example due to vibrations in the engine area, are avoided or in the case of the fuel distribution rail as per this invention, especially areas known to be weak joint areas. Thus, a fuel distribution rail as per this invention distinguishes itself through notable advantages when compared to fuel distribution rails known up to now. Worth particular mention is also that a fuel distribution rail as per this invention can be realized with minimal effort and also at minimal cost.

The invention is explained below in more detail with the help of the accompanying drawings.

DETAILED DESCRIPTION OF ILLUSTRATED EMBODIMENTS

Figure 1:
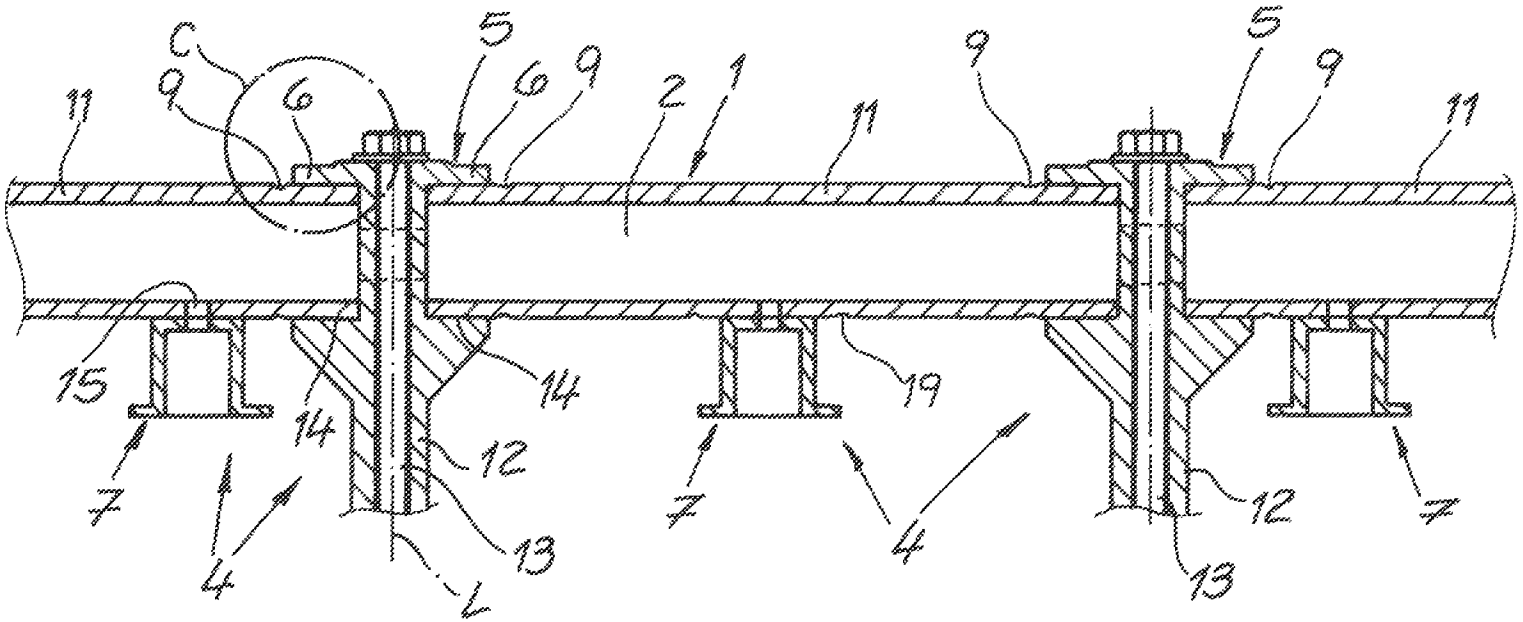
FIG. 1 a side view of a fuel distribution rail according to the present invention.

FIG. 1 shows a fuel distribution rail in accordance with the present invention for a fuel injection system for a combustion engine. The fuel distribution rail has a base tube or housing 1 defining a fuel channel 2 extending longitudinally of the base tube 1. The base tube 1 with its fuel channel 2 is preferably in the form of a steel tube. A number of connector devices 4 are preferably, and in the example, arranged along the length of the base tube 1.

In the preferred embodiment and in the example, the base tube 1 is divided into a number of tube sections 11 which are preferably made of steel. A part of the connector devices 4 are fashioned as connector adapters 5, each of which connect two tube sections 11 of the base tube 1 with one another.

It is within the framework of this invention that each connector adapter 5 is made of steel or essentially of steel. Preferably and in the example, every connector adapter 5 has two surrounding flange components 6 and a connection piece 12 extending transversely to the base tube 1 or to the fuel channel 2. In the example, a fixing screw 13 is passed through the connection pieces 12. The fuel distribution rail is fastened with the fixing screws 13 to an engine (not shown in the figures).

In the recommended embodiment and in the example, a connector adapter 5 is connected to the attached tube sections 11 by soldered joints. As shown above, such a connection area is particularly mechanically unstable and therefore is a weak point of the fuel distribution rail with regard to mechanical stresses. Preferably and in the example, the flange component 6 of each connector adapter 5 forms a recess or bore 14 that receives an end of a tube section 11 where the tube section end and the flange component are joined by a soldered joint 8. Preferably, and in the example, the end of the tube sections 11 grip the flange components 6 within recesses 14 with a tight fit and the surrounding tube sections are connected to the flange components 6 in these connecting recesses 14 by soldered joints 8.

It is within the framework of this invention that at least one force relieving groove 9 is provided in the region of the connector adapter 5 in the outer surface of the base tube 1 or the outer surface of each tube section 11. As per the preferred embodiment and in the example, a force relieving groove 9 extends around the entire circumference of the base tube 1 or the tube section 11. As recommended and in the example, there is such a force relieving groove 9 in each of the tube sections 11 on both sides of a connector adapter 5.

It is further within the framework of this invention that, as in the example, other connector devices 4 in the form of connecting branches 7 are connected to the base tube 1 or to the tube sections 11 of base tube 1. The connecting branches 7 extend transversely to the base tube 1 or transversely to the fuel channel 2 and are in fluid communication with the fuel channel 2 through connection bores 15 provided in the base tube 1 or in the tube sections 11. The connecting branches 7 are preferably and in the example, arranged parallel to each other. It is within the framework of this invention that there is also a force relieving groove 19 or force relieving grooves on the connecting branches 7 or on the base tube sections 11 on both sides opposite to connecting branches 7, (See FIG. 1).

In accordance with the invention, the distance "a" between the minimum depth of a force relieving groove 9 and the longitudinal central axis "L" of the adjacent connection piece 12 is expediently and in the example, 8 to 20 mm. The distance "A" between the groove minimum depth 10 of a force relieving groove 9 of a tube section 11 and the tube end 16 of the associated tube section 11 enclosed in the next neighboring connector adapter 5 is preferably, and in the example, 10 to 12 mm.

Figure 2:
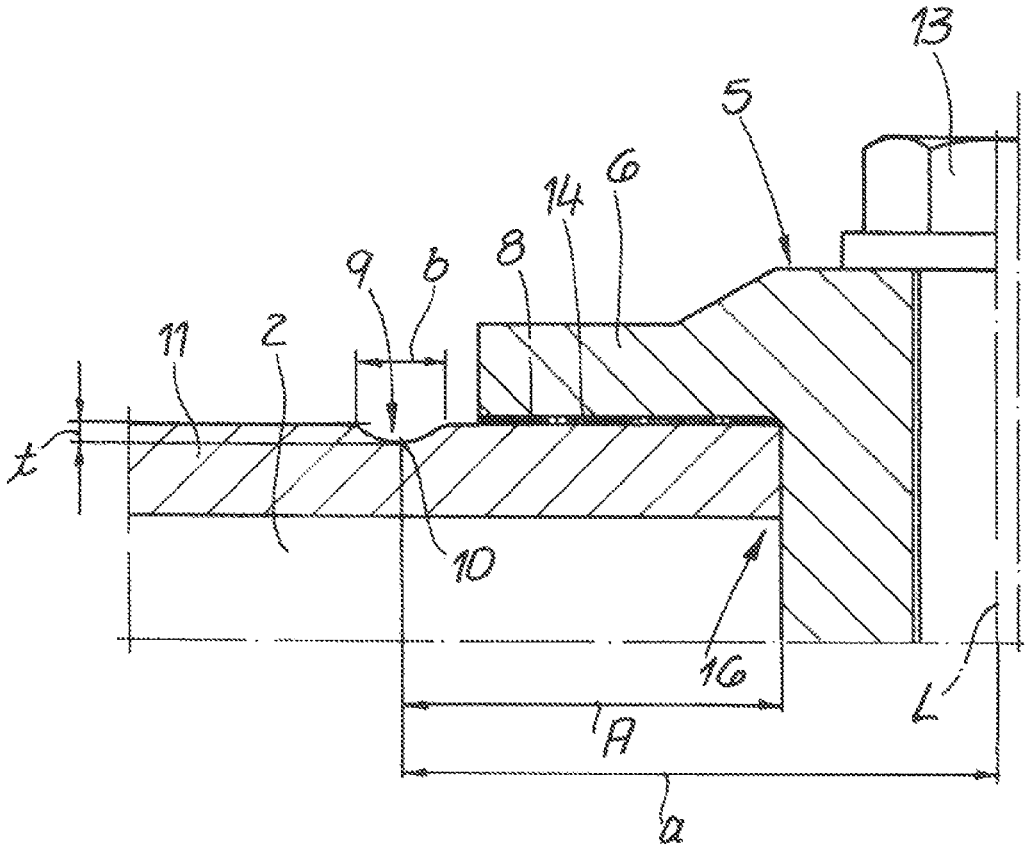
FIG. 2 an enlarged sectional view of the portion of the fuel distribution rail of FIG. 1, within the encircled portion of FIG. 1 designated C.

The groove minimum depth 10 is the lowest point of the force relieving groove 9 relative to the outer surface of the base tube 1. Particularly it can be seen in FIG. 2 that a force relieving groove 9 has preferably a circular crescent shaped cross section. Preferably a force relieving groove 9 has a maximum depth "t" of 0.4 to 0.6 mm. The maximum depth "t" is measured from the groove minimum depth 10 to the outer surface of the base tube section 11. The maximum width "b" of a force relieving groove 9 relative to the outer surface of the tube section 11 is, as per recommendation, 2 to 3 mm.

In this illustrated embodiment the dimensions of the force relieving groove as described herein is contemplated for a base tube 1 or tube sections 11 having a diameter expediently 15 to 27 mm, and preferably 17 to 25 mm. The wall thickness of the base tube 1 or base tube sections 11 is expediently 2 to 4 mm and preferably 2 to 3.5 mm. It should be noted that in the embodiment illustrated, the base tube 1 is comprised of cylindrical tube sections 11. Hence, the force relieving grooves 9 are illustrated as circular, surrounding the outer cylindrical surface of the base tube 1, or its tube sections 11. It must be understood, however, that the base tube 1 may not be cylindrical and could have a square, rectangular, oval, or other suitable cross-section. In such instances the force relieving grooves would have a corresponding peripheral configuration.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The claims are to be construed to include alternative embodiments to the extent permitted by the prior art.

The invention claimed is:

1. A fuel distribution rail for a fuel injection system for an internal combustion engine, having a base tube comprising at least one tube section defining a fuel channel extending in a longitudinal direction of the base tube, at least one connector device fixed on the base tube, at least one force relieving groove on the outer surface of the base tube spaced from the at least one connector device and extending over at least part of the outer surface of the base tube, wherein the base tube comprises a metal tube.

2. A fuel distribution rail in accordance with claim 1, wherein said base tube comprising a plurality of tube sections with several connector devices distributed over a length of the base tube and a force relieving groove on the surface of said tube sections spaced from each connector device.

3. A fuel distribution rail in accordance with claim 2, wherein said at least one connector devices are connector adapters for connecting together said plurality of tube sections of the base tube.

4. A fuel distribution rail for a fuel injection system for an internal combustion engine, having a base tube comprising at least one tube section defining a fuel channel extending in a longitudinal direction of the base tube, at least one connector device fixed on the base tube, at least one force relieving groove on the outer surface of the base tube spaced from the at least one connector device and extending over at least part of the outer surface of the base tube, wherein said base tube comprising a plurality of tube sections with several connector devices distributed over the length of the base tube and a force relieving groove on the surface of said tube sections spaced from each connector device, wherein said at least one connector devices are connector adapters for connecting together said plurality of tube sections of the base tube, wherein said connector adapters include flange components each defining a recess and said base tube includes metal tube sections, preferably of steel or essentially of metal, particularly essentially of steel with the ends of said tube sections in said recesses.

5. A fuel distribution rail in accordance with claim 3, wherein said connector adapters have a flange component defining recesses connected to said tube section at least partially surrounding an end of said tube sections.

6. A fuel distribution rail in accordance with claim 5, wherein the connection of said connector adapter and said base tube or tube sections is a soldered connection and/or a welded connection.

7. A fuel distribution rail in accordance with claim 6, wherein the flange component of the connector adapters is connected to the base tube or a tube section over a soldered connection and/or a welded connection completely surrounding said ends of said tube sections.

8. A fuel distribution rail in accordance with claim 1, wherein at least one connector device is a connecting branch connected to the base tube or a tube section, the connection branch extending transversely to the base tube or transversely to the tube section and the connection branch has a fluid connection with the fuel channel.

9. A fuel distribution rail in accordance with claim 1, wherein said force relieving groove surrounds an entire outer circumference of the base tube or the tube section.

10. A fuel distribution rail in accordance with claim 1, where said force relieving groove has a crescent shaped that includes a circular crescent shaped cross section.

11. A fuel distribution rail in accordance with Claim 1, wherein said force relieving groove has a maximum depth (t) of 0.2 to 1 mm relative to the outer surface of said base tube.

12. A fuel distribution rail in accordance with claim 1, wherein a distance (A) between a force relieving groove minimum depth of the force relieving groove of the tube section and the tube end of the tube section incorporated in the next neighboring connector adapter is 7 to 15 mm.

13. A fuel distribution rail in accordance with claim 1, wherein a distance between a groove minimum depth of the force relieving groove and a central axis or longitudinal central axis (L) of a next neighboring connection adapter is 8 to 20 mm.

14. A fuel distribution rail in accordance with claim 1, wherein an outer diameter of the base tube or of the tube section is 15 to 27 mm.

15. A fuel distribution rail in accordance with claim 1, wherein a wall thickness (d) of the base tube or the tube section is 2 to 4 mm.

16. A fuel distribution rail in accordance with claim 4, wherein at least one connector device is a connecting branch connected to the base tube or a tube section, the connection branch extending transversely to the base tube or transversely to the tube section and the connection branch has a fluid connection with the fuel channel.

17. A fuel distribution rail in accordance with claim 4, wherein said force relieving groove surrounds an entire outer circumference of the base tube or the tube section.

18. A fuel distribution rail in accordance with claim 4, where said force relieving groove has a crescent shaped that includes a circular crescent shaped cross section.

19. A fuel distribution rail in accordance with claim 4, wherein said force relieving groove has a maximum depth (t) of 0.2 to 1 mm relative to the outer surface of said base tube.

20. A fuel distribution rail in accordance with claim 4, wherein a distance (A) between a force relieving groove minimum depth of the force relieving groove of the tube section and the tube end of the tube section incorporated in the next neighboring connector adapter is 7 to 15 mm.

* * * * *